US006944302B2

(12) United States Patent
Onishi et al.

(10) Patent No.: US 6,944,302 B2
(45) Date of Patent: Sep. 13, 2005

(54) SOUND REPRODUCING SYSTEM

(75) Inventors: Masahide Onishi, Osaka (JP); Fumiyasu Konno, Osaka (JP); Akinori Hasegawa, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 256 days.

(21) Appl. No.: 10/344,542

(22) PCT Filed: Jun. 18, 2002

(86) PCT No.: PCT/JP02/06080

§ 371 (c)(1),
(2), (4) Date: Jul. 17, 2003

(87) PCT Pub. No.: WO02/104068

PCT Pub. Date: Dec. 27, 2002

(65) Prior Publication Data

US 2004/0096067 A1 May 20, 2004

(30) Foreign Application Priority Data

Jun. 19, 2001 (JP) ..... 2001-184491

(51) Int. Cl.[7] ..... H04R 29/00; H04R 3/00
(52) U.S. Cl. ..... 381/59; 381/96
(58) Field of Search ..... 381/58, 59, 96, 381/101, 102

(56) References Cited

U.S. PATENT DOCUMENTS 5,418,860 A * 5/1995 Daniels ..... 381/400
5,729,611 A * 3/1998 Bonneville ..... 381/55
5,812,686 A * 9/1998 Hobelsberger ..... 381/96
6,088,459 A * 7/2000 Hobelsberger ..... 381/96
6,122,385 A * 9/2000 Konno et al. ..... 381/96
6,282,296 B1 * 8/2001 Konno et al. ..... 381/96
6,370,253 B1 * 4/2002 Onishi et al. ..... 381/98
6,522,757 B1 * 2/2003 Hiramatsu et al. ..... 381/96
2003/0210798 A1 * 11/2003 Ohyaba ..... 381/96

FOREIGN PATENT DOCUMENTS

| | | |
|---|---|---|
| JP | 1-282996 | 11/1989 |
| JP | 5-30588 | 2/1993 |
| JP | 2000-23282 | 1/2000 |

OTHER PUBLICATIONS

Search Report corresponding to application No. PCT/JP02/06080 dated Sep. 10, 2002.
English translation of PCT/ISA/210.

* cited by examiner

*Primary Examiner*—Xu Mei
(74) *Attorney, Agent, or Firm*—RatnerPrestia

(57) ABSTRACT

In a sound reproducing apparatus, a target control value is determined automatically from a noise and a sound radiated from a loudspeaker unit, and a volume of a reproduced sound is naturally compensated according to an amount of the noise against a masking due to a noise at a listening point. A first microphone is located near a loudspeaker box, and a second microphone is located in the loudspeaker box. A gain of s variable gain amplifier is changed so that an integrated value of a signal obtained by filtering and adding the outputs of the microphone may be equal to an integrated value of the filtered signal of the output of the variable gain amplifier.

8 Claims, 4 Drawing Sheets

SOUND REPRODUCING SYSTEM

THIS APPLICATION IS A U.S. NATIONAL PHASE APPLICATION OF PCT INTERNATIONAL APPLICATION PCT/JP02/06080 filed Jun. 18, 2002.

FIELD OF THE INVENTION

The present invention relates to a sound reproducing apparatus capable of obtaining a sound reproduced through a loudspeaker even in a noisy place, such as an automobile compartment.

BACKGROUND OF THE INVENTION

FIG. 6 is a block diagram of a conventional automatic volume controller disclosed in Japanese Patent Laid-Open No. 5-30588. A signal entered through an input terminal 1 is amplified in power with a first amplifier 2 and is reproduced through a loudspeaker 3. The gain of the first amplifier 2 is controlled by a control signal from a control microcomputer 13. A microphone 6 located near the loudspeaker 3 captures a reproduced sound 4 from the loudspeaker 3 and a surrounding noise 5. The output of the microphone 6 is amplified with a second amplifier 7. A phase inverter 8 and a compensation circuit 9 correct a level and phase of the output of the first amplifier 2 at every frequency so as to cancel a component from the loudspeaker 3 out of the output from the second amplifier. Outputs of the second amplifier 7 and the compensation circuit 9 are added to each other with an adder 10. The adder 10 extracts only the surrounding noise around the loudspeaker 3. The output of the adder 10 is smoothed to be a direct-current with an integrating circuit 11, is digitized by an analog-to-digital (A/D) converter 12, and is put into the control microcomputer 13.

When the noise is ignorable, the volume of the loudspeaker 3 is set at a predetermined level (initial volume). That is, the microcomputer 13 sets the gain of the first amplifier 2 based on only a volume-operation signal 14. The control signal from the microcomputer 13 at this moment is a reference control signal. The output signal of the A/D converter 12 at this moment is zero.

When the noise is generated, the microcomputer 13 calculates the ratio of the reference control signal to the output of the A/D converter 12. The ratio is further compared with a reference ratio which is a threshold for determining that the gain of the first amplifier 2 is raised. When the ratio is below the reference ratio, the initial volume is maintained. That is, it is determined that the noise is not too serious as to raise the volume. On the other hand, when the ratio exceeds the reference ratio, a portion exceeding the reference ratio is divided into predetermined ranges. Then, the microcomputer 13 outputs a control signal so as to raise the volume according to a specified range of the ranges. The control signal changes the gain of the first amplifier 2 to adjust the volume of the sound reproduced through the loudspeaker 3.

In a conventional automatic volume controller, when the ratio is less than the reference ratio, the microcomputer 13 does not output the control signal to raise the gain of the first amplifier 2, thus not controlling the volume despite the existing noise.

Even if the ratio exceeds the reference ratio, a control amount according to the range must be preliminarily determined. Further, the control signal changes the gain of the first amplifier 2 in steps, not continuously, thus having the loudspeaker 3 reproduce sound unnaturally.

SUMMARY OF THE INVENTION

A sound reproducing apparatus includes a variable gain amplifier, a power amplifier for amplifying an output of the variable gain amplifier, a loudspeaker box including a loudspeaker unit having a diaphragm for reproducing an output of the power amplifier, a microphone located near the loudspeaker box for capturing a mixed sound including a sound radiated from the loudspeaker unit and a noise around the loudspeaker box, a detector for detecting a physical quantity varying according to a motion of the diaphragm, a combining section for combining an output of the microphone and an output of the detector, and a comparing section for comparing an integral value obtained by integrating an output of the combining section and an integral value obtained by integrating an output of the variable gain amplifier, and for outputting a control signal for controlling the variable gain amplifier so that the integral values are equal to each other.

In the sound reproducing apparatus, a control target value is determined automatically from the radiation sound radiated through the loudspeaker unit and the noise, and the gain of the variable gain amplifier varies according to the noise. Therefore, regardless of the amount of the noise, the sound reproducing apparatus compensates the volume naturally against a masking at a listening point.

DETAILED DESCRIPTION OF THE PREFERRED EMBODIMENT

Figure 1:
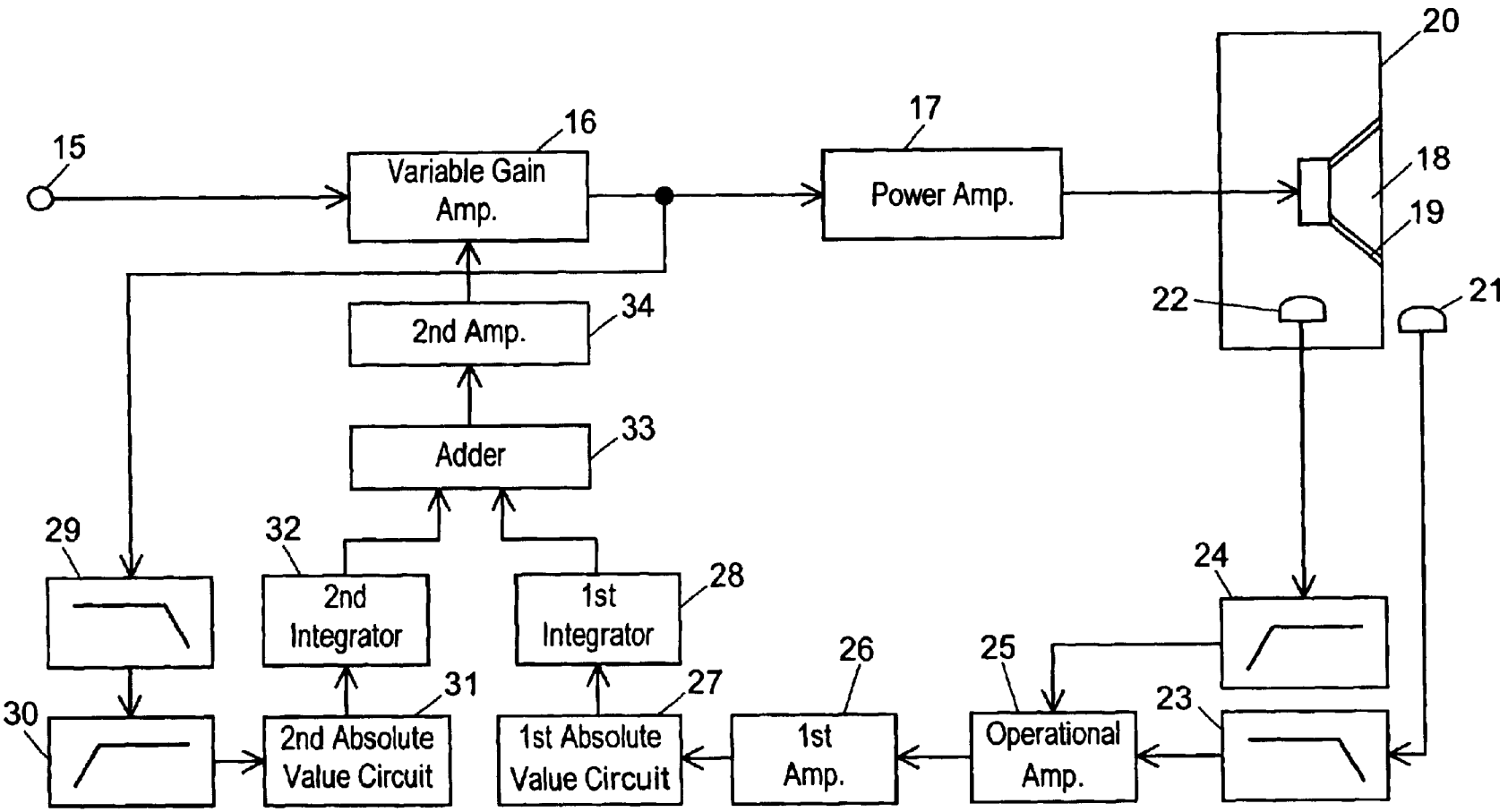
FIG. 1 is a block diagram of a sound reproducing apparatus according to an exemplary embodiment of the present invention.

FIG. 1 is a block diagram of a sound reproducing apparatus according to an exemplary embodiment of the present invention. A signal entering from an input terminal 15 is input to a variable gain amplifier 16. The amplifier 16 is controlled by a control signal, a control voltage in the embodiment, generated according to a sound radiated from a loudspeaker unit 18 and a noise. An initial reference value of this control voltage is a reference control voltage, which provides the variable gain controller 16 with an initial gain. When the control voltage is lower than the reference control voltage, the variable gain amplifier 16 has a gain greater than the initial gain. The output of the amplifier 16 is input into the power amplifier 17, and the output of the power amplifier 17 is reproduced by the loudspeaker unit 18 in a loudspeaker box 20. A first microphone 21 is located near the loudspeaker box 20 and produces the sum of a noise around the loudspeaker box 20 and the sound radiated from the loudspeaker unit 18. In the loudspeaker box 20, a second microphone 22 is located as a detector for detecting a physical quantity varying according to a motion of a diaphragm 19 of the loudspeaker unit 18.

Figure 2:
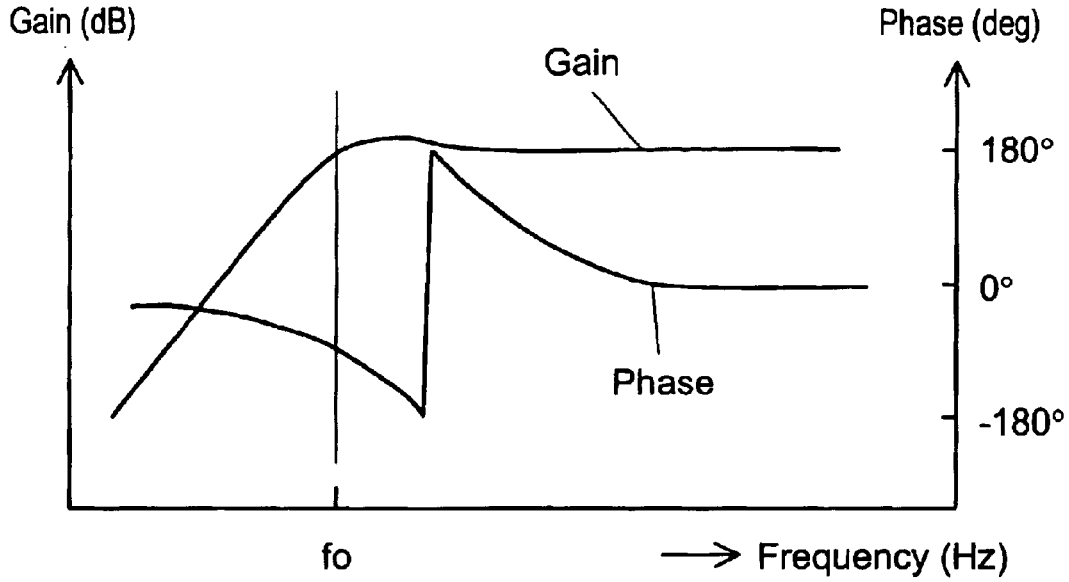
FIG. 2 is an output characteristic diagram of a first microphone of the sound reproducing apparatus according to the embodiment.
Figure 3:
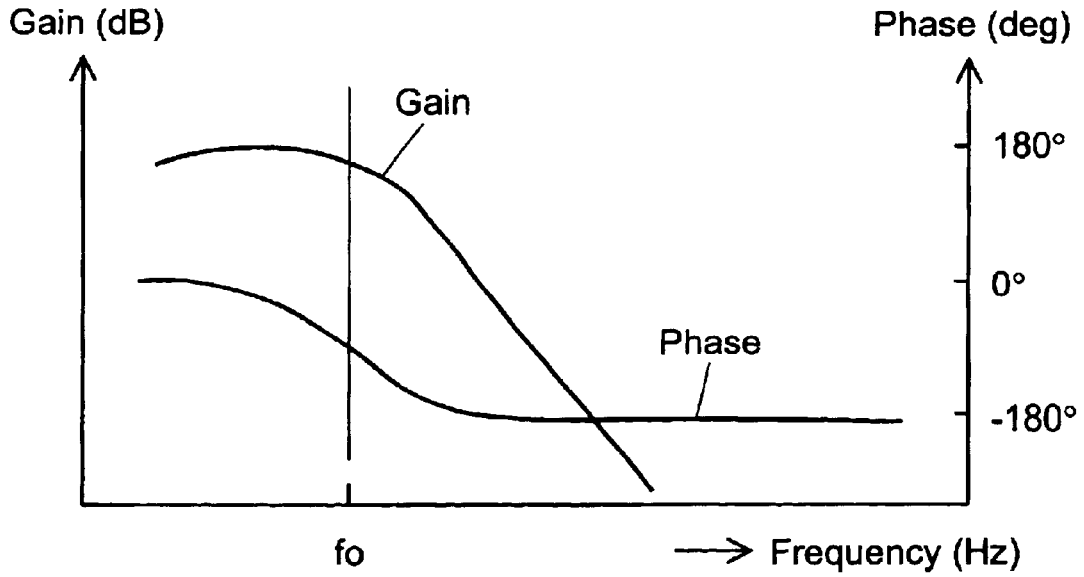
FIG. 3 is an output characteristic diagram of a second microphone of the sound reproducing apparatus according to the embodiment.

FIG. 2 shows gain/phase-frequency characteristics of the output of the first microphone 21 in response to the output of the variable gain amplifier 16 with no noise around it. The signal radiated from the loudspeaker unit 18 has characteristics similar to that of a second-order high pass filter, as shown in FIG. 2. FIG. 3 shows gain/phase-frequency characteristics of the output of the second microphone 22 in response to the output of the variable gain amplifier 16 with no noise around it. The detected motion of the diaphragm 19 of the loudspeaker unit 18 in the loudspeaker box 20 has characteristics similar to that of a second-order low pass filter, as shown in FIG. 3.

The first microphone 21 located near the loudspeaker box 20 captures a noise around the unit 18 and the sound radiated from the loudspeaker unit 18. The sound is greater than that at a listening point. If only a component of the sound radiated from the loudspeaker unit 18 can be eliminated from the output of the first microphone 21, sound characteristics of the sound radiated from the loudspeaker unit 18 at the listening point and sound characteristics of the noise can be simulated.

As shown in FIG. 2 and FIG. 3, the output of the first microphone 21 and the output of the second microphone 22 are equivalent to the second-order high pass filter and second-order low pass filter having an identical lowest resonance frequency (f0), respectively.

Figure 4:
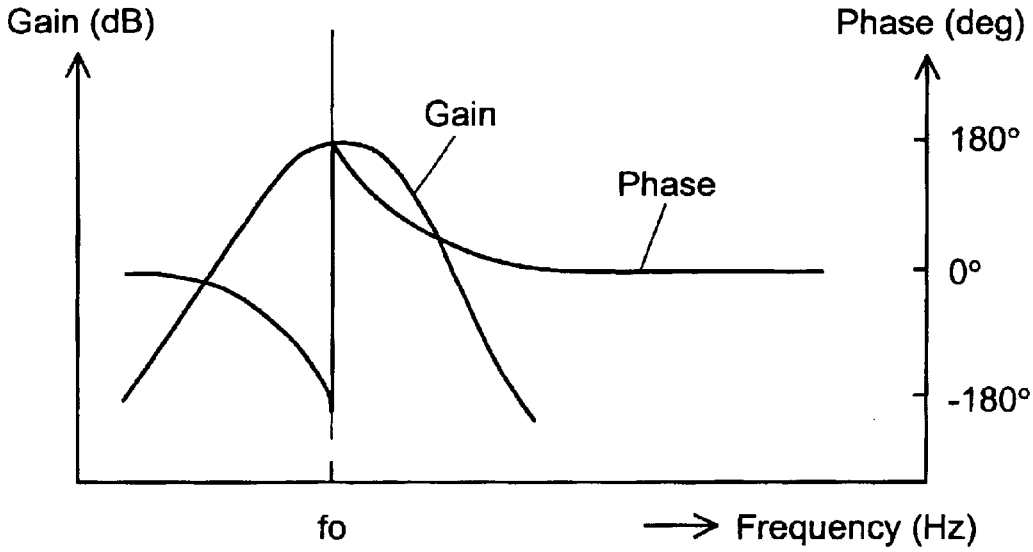
FIG. 4 is an output characteristic diagram of a first low pass filter of the sound reproducing apparatus according to the embodiment.
Figure 5:
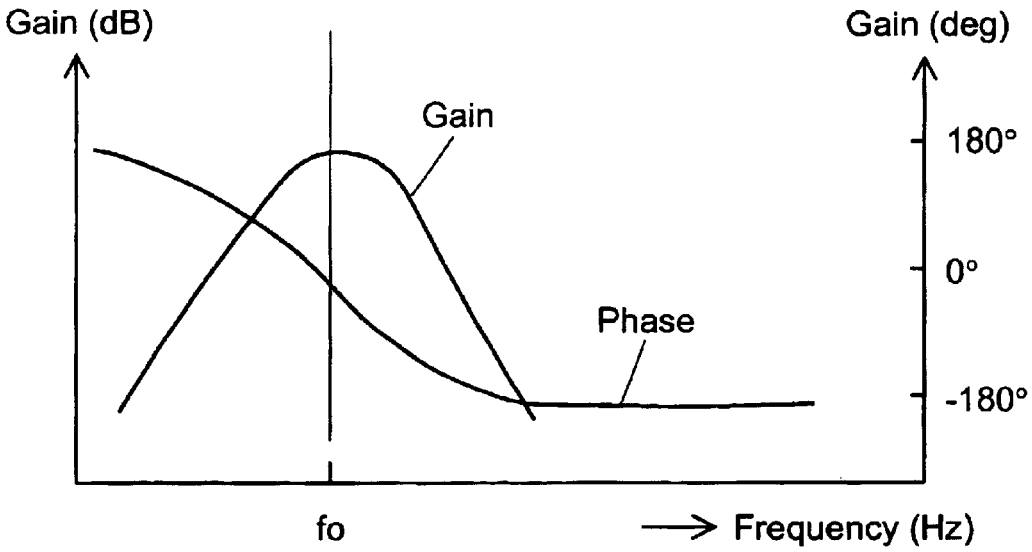
FIG. 5 is an output characteristic diagram of a first high pass filter of the sound reproducing apparatus according to the embodiment.
Figure 6:
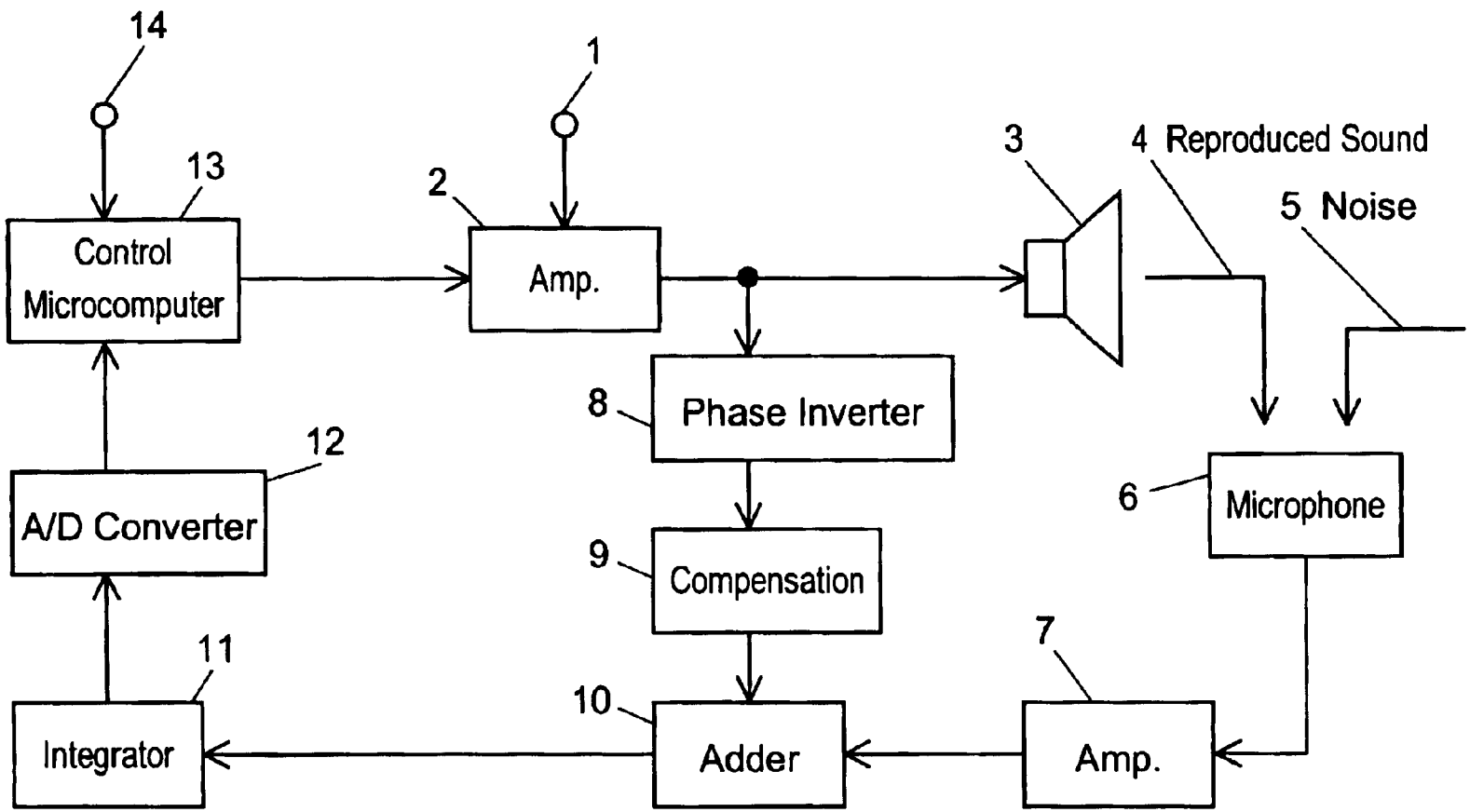
FIG. 6 is a block diagram of a conventional sound reproducing apparatus.

The output of the first microphone 21 and the output of the second microphone 22 are combined with a combining section including a first compensation circuit, a second compensation circuit, and an operational amplifier explained below. A second-order first low pass filter 23 as the first compensation circuit and a second-order first high pass filter 24 as the second compensation circuit have cut-off frequencies equal to the lowest resonance frequencies (f0) of the loudspeaker unit 18 captured with the first and second microphones 21 and 22, respectively. The first microphone 21 is connected to the first low pass filter 23, and the second microphone 22 is connected to the first high pass filter 24. FIG. 4 shows gain/phase-frequency characteristics of the output of the first low pass filter 23 connected to the first microphone 21, and FIG. 5 shows gain/phase-frequency characteristics of the output of the first high pass filter 24 connected to the second microphone 22. As shown in FIG. 4 and FIG. 5, the first low pass filter 23 and the first high pass filter 24 have substantially the same gain-frequency characteristics as the output of band pass filters, and have phases inverted against each other. The output of the first low pass filter 23 and the output of the first high pass filter 24 are input to an operational amplifier 25. Only the component of the sound radiated from the loudspeaker unit 18 is subtracted from the output of the first low pass filter 23, and thus, in a frequency band passing through the first low pass filter 23, the operational amplifier 25 enables simulation of a sound field composed of radiation sound from the loudspeaker unit 18 and a noise at the listening point.

The noise around the loudspeaker box 20 and the noise at the listening point have sound characteristics equivalent to each other, and an amplitude of the sound radiated from the loudspeaker unit 18 at the listening point decreases by X(dB) as compared with an amplitude at the place of the first microphone 21. The gain of the operational amplifier 25 is determined according to the output of the first high pass filter 25, so that the amplitude of the component radiated from the loudspeaker unit 18 included in the output of the first low pass filter 23 may decrease by X(dB), The output of the variable gain amplifier 16 is connected to a second low pass filter 29 in a third compensation circuit composed of the second low pass filter 29 and a second high pass filter 30. Cut-off frequencies of the second-order second low pass filter 29 and secondary second high pass filter 30 are set to the lowest resonance frequencies (f0) of the loudspeaker unit 18 captured by the first and second microphones 21 and 22, respectively. The output of the variable gain amplifier 16, upon, passing through the second low pass filter 29 and the second high pass filter 30, has substantially the same gain-frequency characteristics as the operational amplifier 25 with no noise. As a result, the sound reproducing apparatus has an enhanced response to the volume control for the noise, and thus, controls the volume accurately even if the noise is small.

The output of an operational amplifier 25 is input to the first amplifier 26 to be amplified. The gain of the first amplifier 26 is set so that the amplitude of the output of the operational amplifier 25 may be equal to the amplitude of the output of the second high pass filter 30. That is, when there is no noise, the gain of the output of the first amplifier 26 is equivalent to the gain of the output of the second high pass filter 30.

The output of the first amplifier 26 is input to a first absolute value circuit 27 which is an inverted type absolute value circuit for outputting an absolute value in a negative direction based on the reference control voltage as a boundary, and is converted into an inverted absolute value. The output of the first absolute value circuit 27 is input to a first integrator 28 and is smoothed. The output of the second high pass filter 30 is input to a second absolute value circuit 31 which is a normal type absolute value circuit for outputting an absolute value in a positive direction based on the reference control voltage as a boundary, and is converted into a normal absolute value. The output of the second absolute value circuit 31 is input to a second integrator 32, and is smoothed. The outputs of the second integrator 32 and the first integrator 28 are input to an adder 33 to be summed. Then, a difference from the reference control voltage is compared and calculated. The output of the adder 33 is input to a second amplifier 34 for amplifying the difference from the reference control voltage, and outputting a control voltage as a control signal for controlling the variable gain amplifier 16.

When there is no noise, as mentioned above, the output of the first amplifier 26 is equal to the output of the second high pass filter 30. Therefore, the outputs of the first integrator 28 and the second integrator 32 have the same absolute values of the differences from the reference control voltage, and have polarities reverse to each other about the reference control voltage. Therefore, when the outputs are added with the adder, the differences are canceled. Therefore, the adder 33 outputs the reference control voltage, and the output of the second amplifier 34 as a control signal for controlling the variable gain amplifier 16 is also the reference control voltage. As a result, the gain of the variable gain amplifier 16 is not changed, and the initial gain determined by the reference control voltage is maintained.

When there is noise, the first microphone 21 captures the noise as well as the sound radiated from the loudspeaker unit 18, and increases an output, which is no longer equal to the output of the second high pass filter 30. That is, the absolute value of the difference between the output of the first integrator 28 and the reference control voltage is larger than the absolute value of the difference between the output of the second integrator 30 and the reference control voltage. Further, the outputs of the first and second integrators 28 and 30 have polarities reverse to each other about the reference control voltage, and therefore, the adder 33 outputs a voltage lower than the reference control voltage. The difference between the output of the adder 33 and the reference control voltage is amplified by the second amplifier 34, and is output as the control voltage V1 for controlling the variable gain amplifier 16. Since being lower than the reference control voltage, the voltage V1 increases the gain of the variable gain amplifier 16 to a gain A1.

When the variable gain amplifier 16 has the increased gain A1 by the control voltage V1, the output of the second high pass filter 30 passing through the variable gain amplifier 16, which is to be input to the second absolute value circuit 31, is increased according to the gain A1. Meanwhile, the sound radiated from the loudspeaker unit 18 increases according to the gain A1, and the component of the sound radiated from the loudspeaker unit 18 included in the output of the first amplifier 26, which is to be input to the first absolute value circuit 27, also increases according to the gain A1. Therefore, concerning components other than the noise, the output of the second high pass filter 30 to be input to the second absolute value circuit 31 and the output of the first amplifier 26 to be input to the first absolute value circuit 27 include the same amplitudes of the components of the sound radiated from the loudspeaker unit 18. Both components are increased according to the gain A1 as compared with the case of no noise, and thus are equal to each other. That is, in the sound reproducing apparatus shown in FIG. 1, only the noise is a factor for changing the gain of the variable gain amplifier 16.

It will be considered that the noise is kept at a specific level. When the noise is constant and the sound radiated from the loudspeaker unit 18 increases, the ratio of the noise to a sound formed by mixing the noise and the sound radiated from the loudspeaker unit 18 captured by the first microphone 21. This allows the sound reproducing apparatus in FIG. 1 to judge that the noise level decreases equivalently, and then, the second amplifier 34 outputs a voltage V2 which is lower than the reference control voltage but higher than the voltage V1. At this moment, the gain A2 of the variable gain amplifier 16 is smaller than the gain A1.

When the noise is constant and the gain of the variable gain amplifier 16 decreases from the gain A1 to the gain A2, the ratio of the noise to the sound including the noise and the sound radiated from the loudspeaker unit 18 captured by the first microphone 21 increases again. This allows the second amplifier 34 to output a control voltage V3 lower than the voltage V2, and the gain A3 of the variable gain amplifier 16 at this time is larger than the gain A2.

Thus, the control voltage increases and decreases repetitively, and finally converges at a certain value lower than the reference control voltage. This value is determined by the level of the sound radiated from the loudspeaker unit 18 and the level of the noise. The operation until the converging is explained in gradual steps herein, but actually, the values converges continuously. Therefore, the gain of the variable gain amplifier 16 naturally converges at a gain determined by the convergent value of the control voltage. If the level of the noise varies, the control value converges at a new value, and changes the gain of the variable gain amplifier 16 accordingly.

Thus, in the sound reproducing apparatus according to the embodiment, in the case that there in no noise, the gain of the variable gain amplifier is maintained constantly at the initial gain. In case that there is a noise, regardless of the level of the noise, a target control value is determined automatically from the noise and the sound radiated from the loudspeaker unit, and the gain of the variable gain amplifier varies according to the noise. This compensates the level of the reproduced sound naturally against a masking at the listening point.

According to the embodiment, the detector for detecting the motion of the diaphragm 19 of the loudspeaker unit 18 is a second microphone 22 located in the loudspeaker box 20. The detector may be a microphone located inside of a dust cap of the loudspeaker unit 18. In this case, a first compensation circuit is composed of a first-order low pass filter, and a second compensation circuit is composed of a first-order high pass filter. The second compensation circuit is adjusted to have band-pass characteristics identical to the gain-frequency characteristics of the component of the sound radiated from the loudspeaker unit 18 included in the output of the first compensation circuit, and to output a signal having a reverse phase. The third compensation circuit is composed of a second-order high pass filter having a cut-off frequency of the lowest resonance frequency (f0) of the loudspeaker unit 18, and a first-order low pass filter having the same cut-off frequency as the first compensation circuit. Thus, in addition to the effects of the embodiment, the first compensation circuit and the second compensation circuit can be adjusted more easily. Further, since the first compensation circuit is composed of a first-order low pass filter, the apparatus can perform a masking compensation against the noise in a wider frequency band.

The detector for detecting the motion of the diaphragm 19 of the loudspeaker unit 18 may be a detection coil located in a bobbin on which a voice coil of the loudspeaker unit 18 is wound. In this case, a first compensation circuit is composed of a second-order low pass filter, and a second compensation circuit is composed of a first-order low pass filter, a second-order high pass filter, and a phase shifter. The second compensation circuit is adjusted to have the same band-pass characteristics as the gain-frequency characteristics for the component of the sound radiated from the loudspeaker unit 18 included in the output of the first compensation circuit, and to output a signal having a reverse phase. The third compensation circuit is composed of a second-order high pass filter having a cut-off frequency of the lowest resonance frequency (f0) of the loudspeaker unit 18, and a second-order low pass filter having the same cut-off frequency as the first compensation circuit. Thus, in addition to the effects of the embodiment, the detection coil can detect only a physical quantity varying according to the motion of the diaphragm of the loudspeaker unit regardless of a noise around the loudspeaker box. This allows the sound reproducing apparatus to simulate sound characteristics of the sound radiated from the loudspeaker unit and sound characteristics of the noise at the listening point precisely.

According to the embodiment, the first absolute value circuit 27 is of an inverted type, and the second absolute value circuit 31 is of a normal type. The first absolute value circuit 27 may be of a normal type, and the second absolute value circuit 31 may be of a reverse type. This arrangement is advantageous for controlling the variable gain amplifier having a gain increased according to an increase of the control voltage in a positive direction, and provides the apparatus with the same effects as in the foregoing embodiment.

INDUSTRIAL APPLICABILITY

In a sound reproducing apparatus according to the present invention, the target control value is automatically determined from a noise and a sound radiated from a loudspeaker unit, and a gain of a variable gain amplifier varies according to the noise. Therefore, regardless of an amount of the noise, the sound reproducing apparatus compensates a volume of a reproduced sound naturally against a masking at a listening point.

What is claimed is:

1. A sound reproducing apparatus comprising:

a variable gain amplifier;

a loudspeaker unit having a diaphragm, for reproducing an output of said power amplifier;

a loudspeaker box for accommodating said loudspeaker;

a microphone located near said loudspeaker box for capturing a mixed sound including a sound radiated from said loudspeaker unit and a noise around said loudspeaker box;

a detector for detecting a physical quantity varying according to a motion of said diaphragm;

a combining section for combining an output of said microphone and an output of said detector; and a comparing section for comparing an integral value obtained by integrating an output of said combining section and an integral value obtained by integrating an output of said variable gain amplifier, and for outputting a control signal for controlling said variable gain amplifier so that said integral values are equal to each other.

2. The sound reproducing apparatus of claim 1, wherein said combining section includes:

a first compensation circuit for receiving an output of said microphone;

a second compensation circuit for receiving an output of said detector; and an operational amplifier for receiving an output of said first compensation circuit and an output of said second compensation circuit, and wherein a difference between a gain to frequencies of a component of said sound radiated from said loudspeaker unit included in said output of said first compensation circuit and a gain to frequencies of an output of said second compensation circuit is constant, and said component of said sound and said output of said second correction circuit have phases reverse to each other.

3. The sound reproducing apparatus of claim 1, wherein said detector including a further microphone.

4. The sound reproducing apparatus of claim 1, wherein said loudspeaker unit includes:

a voice coil; and a bobbin on which said voice coil is wound, and wherein said detector including a detection coil located at said bobbin.

5. The sound reproducing apparatus of any one of claims 1, wherein said comparing section includes:

a first amplifier for amplifying an output of said combining section;

a first absolute value circuit for outputting an absolute value of an output of said first amplifier; circuit;

a second absolute value circuit for outputting an absolute value of an output of said variable gain amplifier;

a second integrator for integrating an output of said second absolute value circuit;

an adder for adding an output of said first integrator to an output of said second integrator; and a second amplifier for amplifying an output of said adder.

6. The sound reproducing apparatus of claim 5, wherein said first absolute value circuit is of a normal type, and said second absolute value circuit is of an inverted type.

7. The sound reproducing apparatus of claim 5, wherein said first absolute value circuit is an inverted type absolute value circuit, and said second absolute value circuit is a normal type absolute value circuit.

8. The sound reproducing apparatus of claim 5, further comprising a third compensation circuit disposed between said variable gain amplifier and said second absolute value circuit, said third compensation circuit having a gain-frequency characteristic substantially identical to a gain-frequency characteristic for said radiated sound totally through said microphone, said detector, said operational amplifier, and said first amplifier.

* * * * *

UNITED STATES PATENT AND TRADEMARK OFFICE

CERTIFICATE OF CORRECTION

PATENT NO. : 6,944,302 B2
DATED : September 13, 2005
INVENTOR(S) : Masahide Onishi et al.

It is certified that error appears in the above-identified patent and that said Letters Patent is hereby corrected as shown below:

Column 7,
Line 9, delete "power" and add -- variable gain --.

Column 8,
Line 10, delete "any one of claims" and add -- claim --.
Line 15, delete "circuit".
Line 15, add -- a first integrator for integrating an output of said first absolute value circuit; --.

Signed and Sealed this

Eleventh Day of April, 2006

JON W. DUDAS
*Director of the United States Patent and Trademark Office*